US010876241B2

(12) United States Patent
Hu et al.

(10) Patent No.: US 10,876,241 B2
(45) Date of Patent: Dec. 29, 2020

(54) CLOTHES PRE-WASH COMPARTMENT FOR AN APPLIANCE

(71) Applicant: Midea Group Co., Ltd., Foshan (CN)

(72) Inventors: Ziqiang Hu, Guangdong (CN); Paul R. Staun, Louisville, KY (US)

(73) Assignee: MIDEA GROUP CO., LTD., Guangdong (CN)

( * ) Notice: Subject to any disclaimer, the term of this patent is extended or adjusted under 35 U.S.C. 154(b) by 326 days.

(21) Appl. No.: 15/941,931

(22) Filed: Mar. 30, 2018

(65) Prior Publication Data

US 2019/0301067 A1 Oct. 3, 2019

(51) Int. Cl.
*D06F 29/00* (2006.01)
*D06F 39/08* (2006.01)

(52) U.S. Cl.
CPC ..... *D06F 29/00* (2013.01); *D06F 39/083* (2013.01); *D06F 39/088* (2013.01)

(58) Field of Classification Search
CPC ..... D06F 39/083; D06F 39/088; D06F 29/00
USPC ..... 68/20
See application file for complete search history.

(56) References Cited

U.S. PATENT DOCUMENTS 5,161,394 A * 11/1992 Felzer et al.
5,253,493 A 10/1993 Ohashi
6,714,768 B2 3/2004 Lempkowski
7,296,443 B2 11/2007 Usherovich et al.
7,313,932 B2 1/2008 Ryohke et al.
8,549,887 B2 10/2013 Reid et al.
9,416,482 B2 8/2016 Alexander et al.
2004/0168481 A1 9/2004 Usherovich et al.
2006/0096335 A1 5/2006 Park et al.
2011/0030148 A1 2/2011 Saubert
2011/0047809 A1* 3/2011 Yoon
2015/0368840 A1* 12/2015 Pollett
2016/0194815 A1 7/2016 Heo et al.

FOREIGN PATENT DOCUMENTS

CN 1648320 A 8/2005
CN 102002838 A 4/2011
CN 204039754 U 12/2014
CN 204039759 U 12/2014
CN 204039780 U 12/2014
CN 204058989 U 12/2014
CN 206189099 U 5/2017
CN 106835607 A 6/2017
CN 107747190 A 3/2018
JP H0375089 A 3/1991
(Continued)

OTHER PUBLICATIONS

CN206189099U—Machine translation (Year: 2017).*
(Continued)

*Primary Examiner* — Tinsae B Ayalew
(74) *Attorney, Agent, or Firm* — Middleton Reutlinger

(57) ABSTRACT

The specification discloses a basin disposed in a top portion of a drying appliance, the basin having a fluid drain therein connected to a basin drain line. The appliance includes a water valve in fluid communication with a water source having an outlet in fluid communication with the basin and a tee connector disposed in a drain line of a washing appliance for draining fluid from the basin.

19 Claims, 3 Drawing Sheets

(56) References Cited

FOREIGN PATENT DOCUMENTS

WO WO2003035961 A2 5/2003

OTHER PUBLICATIONS

CN 107747190A—Machine translation (Year: 2018).*
CN 106835607A—Machine translation (Year: 2017).*
CNET "How to Buy a Washing Machine in 2017" www.CNET.com. First retrieved on Nov. 9, 2017.
Samsung "6 Ways to Pre-Treat Your Clothing" www.techlife.samsung.com. First retrieved on Nov. 9, 2017.
International Search Report and Written Opinion issued in Application No. PCT/CN2019/078024 dated Jun. 12, 2019.

* cited by examiner

CLOTHES PRE-WASH COMPARTMENT FOR AN APPLIANCE

BACKGROUND

Modern appliances for washing and drying articles, typically clothing and other textiles or fabrics, are commonly arranged into dedicated washers and dryers usually arranged side-by-side for ease of access and installation. When arranged in this fashion, the top or upper surface of the drying appliance is generally an unused flat surface since many dryer designs utilize front-loading doors to add and remove articles to the dryer's interior. Some front-loading washing machines are also designed with an unused, flat upper surface, hut many washing machines are top-loading designs where a lid is lifted for access to a clothes agitator.

In many circumstances certain articles of clothing or other textiles such as tablecloths or napkins need to be pre-treated prior to the regular machine wash in order to treat hard to remove stains or heavy soils. Often the article being pre-treated must be moistened or wetted during the pre-treatment process. The top surface of a dryer provides a convenient location for scrubbing or applying stain treatments to these articles prior to washing, although this process often results in a damp or messy dryer top.

To address this problem, some prior art washing machines have begun including pre-treatment compartments in the top surfaces thereof, although this arrangement requires a front-loading washing machine which is not always desirable. Additionally, at least one prior art dryer has included a sink unit in its top surface. However, this design is primarily provided for partial-wash and dry systems and steam dryers that already have dedicated waste-water pumps integrated therein and thus it provides no guidance on removing the used fluid from a dryer-mounted sink.

Accordingly, there is a need in the art for a system and apparatus of treating an article in an appliance mounted sink or basin that provides both a flat surface for pre-treatment operations and a simple and economical way a removing unwanted water and pre-treatment solutions.

SUMMARY

In some aspects and embodiments of the invention a front-loading dryer having a basin for the pre-treatment of clothing or other articles that need to be cleaned disposed in the top surface thereof is provided. The basin may include a manual drain stopper or alternatively an electrically actuated drain stopper as well as a source or supply of water provided through a spigot or port. The water source may be in fluid communication with a manual or electrical valve to fill the basin. In some embodiments a cleaning wand or brush may be provided in or proximate the basin In some embodiments, the basin drain is in fluid communication with a drain line that may be tied to a washer drain line so that fluid from the dryer basin drains through an existing washer drain line. In exemplary but non-limiting embodiments a tee drain line fitting is provided to pipe the dryer basin drain to an existing washer drain. In these embodiments the basin line simply drains by normal operation of the existing washer drain line.

In various embodiments, the tee fitting may be provided with a dryer drain line cheek valve that prohibits water draining from the washer drain line entering the dryer drain line. In corresponding fashion, the tee fitting is also provided with a washer drain line check valve that prohibits water draining from the dryer drain line from entering the washer drain line.

In some embodiments of the system described here the washer and dryer may each include a controller having a process, concomitant data memory, and a plurality of electrical signal inputs and outputs for operating and communicating with various system components.

In various embodiments a fluid level sensor is disposed proximate a top portion of the basin to detect a high water level therein. The controller may monitor this fluid level sensor and disable a water supply valve to prohibit basin overflow. In some other embodiments a fluid level sensor may be provided in the tee fitting that is monitored by the washer controller or the dryer controller. This embodiment permits the controller to prohibit draining the basin when the washer is in a cycle that prevents its drain line from being used for basin drain water.

In various embodiments, both the drying appliance and concomitant washing appliance may be provided with a communications interface that provides data communications between the two appliances, either via an internet connection or alternatively through another data network. In some embodiments the drying appliance may be provided with a signal from the washing appliance that prohibits draining the dryer basin when the washer is in a cycle that prevents its drain line from being used for basin drain water.

As used herein for purposes of the present disclosure, the term "communications interface is used herein to generally describe apparatus and systems relating to the wireless or wired transmission of a signal. Any of a wide variety of wireless or wired transmission devices and communications protocols may be employed in the system of the invention, including analog and digital transmission systems. Exemplary but non-limiting wired transmitters that may form a part of the invention include Ethernet and fiber-optic systems. Exemplary but nonlimiting wireless transmitters that may form a part of the invention include radio transmitters, cellular transmitters, LTE and LTE advanced systems, ZigBee™, Wi-Fi and Bluetooth transmitters. Additionally, a plurality of wireless and/or wired network and transmission systems may be employed without departing from the scope of the invention, including but not limited to wireless personal area networks, local area networks, mesh networks, metropolitan area and global area networks.

The term "processor" or alternatively "controller" is used herein generally to describe various apparatus relating to the operation of one or more light sources. A controller can be implemented in numerous ways (e.g., such as with dedicated hardware) to perform various fitactions discussed herein. A "processor" is one example of a controller which employs one or more microprocessors that may be programmed using software (e.g., microcode or machine instructions) to perform various functions discussed herein. A controller may be implemented with or without employing a processor, and also may be implemented as a combination of dedicated hardware to perform some functions and a processor (e.g., one or more programmed microprocessors and associated circuitry) to perform other functions. Examples of controller components that may be employed in various embodiments of the present disclosure include, but are not limited to, conventional microprocessors, application specific integrated circuits (ASICs), and field-programmable gate arrays (FPGAs).

In various implementations, a processor or controller may be associated with one or more storage media (generically referred to herein as "memory," e.g., volatile and nonvolatile computer memory such as RAM, PROM, EPROM, and EEPROM, floppy disks, compact disks, optical disks, magnetic tape, etc.). In some implementations, the storage media may be encoded with one or more programs that, when executed on one or more processors and/or controllers, perform at least some of the functions discussed herein. Various storage media may be fixed within a processor or controller or may be transportable, such that the one or more programs stored thereon can be loaded into a processor or controller so as to implement various aspects of the present disclosure discussed herein. The terms "program" or "computer program" or "instructions" are used herein in a generic sense to refer to any type of computer code (e.g., software or microcode) that can be employed to program one or more processors or controllers.

The term "user interface" as used herein refers to an interface between a user or an operator and one or more devices that enables interaction between the user and the device(s). Examples of user interfaces that may be employed in various implementations of the present disclosure include, but are not limited to, switches, potentiometers, buttons, dials, sliders, a mouse, keyboard, keypad, various tees of game controllers (e.g., joysticks), track balls, display screens, various types of graphical user interfaces (GUIs), touch screens, microphones and other types of sensors that may receive some form of human-generated stimulus and generate a signal in response thereto.

It should be appreciated that all combinations of the foregoing concepts and additional concepts discussed in greater detail below (provided such concepts are not mutually inconsistent) are contemplated as being part of the inventive subject matter disclosed herein. In particular, all combinations of claimed subject matter appearing at the end of this disclosure are contemplated as being part of the inventive subject matter disclosed herein. It should also be appreciated that terminology explicitly employed herein that also may appear in any disclosure incorporated by reference should be accorded a meaning most consistent with the particular concepts disclosed herein.

These and other advantages and features, which characterize the embodiments, are set forth in the claims appended hereto and form a further part thereof. Now for a better understanding of the embodiments and of the advantage and objectives attained through their use, reference should be made to the Drawing Figures and to the accompanying specification, in which there are described exemplary embodiments. This summary is merely provided to introduce a selection of concepts that are further described below in the detailed description, and is not intended to identify key or essential features of the claimed subject matter, nor is it intended to be used in limiting the scope of the claimed subject matter.

BRIEF DESCRIPTION OF THE DRAWINGS

In the drawings, like reference characters generally refer to the same parts throughout the different views. Also, the drawings are not necessarily to scale, emphasis instead generally being placedupon illustrating the principles of the invention.

DETAILED DESCRIPTION

Numerous variations and modifications will be apparent to one of ordinary skill in the art, as will become apparent from the description below. Therefore, the invention is not limited to the specific implementations discussed herein.

The embodiments discussed herein will focus on the implementation of the described techniques and apparatuses for a residential appliance such as a washing or drying appliance. While the embod ments described herein will refer generally to implementation within a drying appliance having a front-loading door, one of ordinary skill will recognize that the invention may be practiced with a broad array of appliances without departing from the scope thereof.

Figure 1:
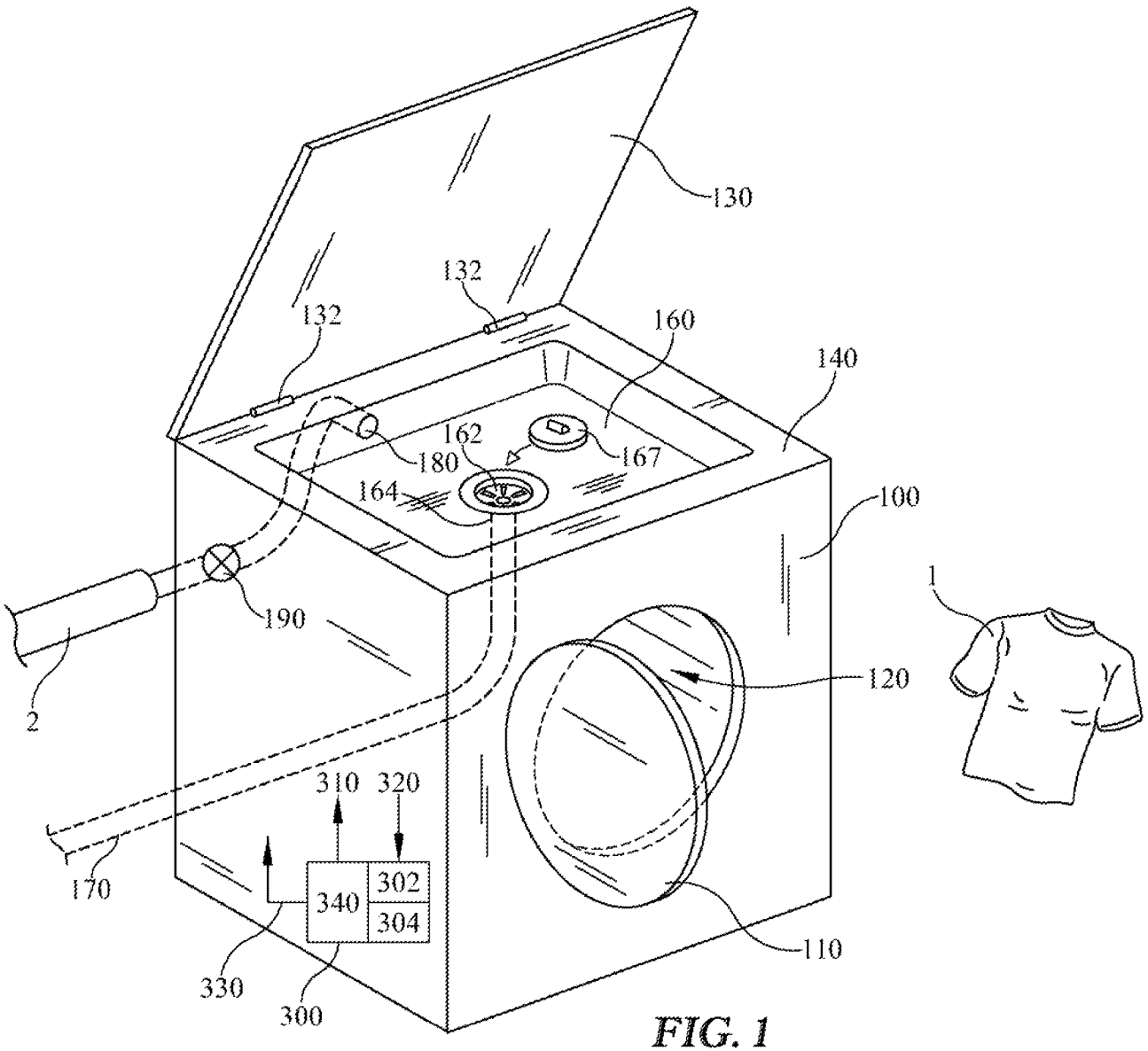
FIG. 1 is an perspective view of a drying appliance, in accordance with various embodiments of the invention.

Referring now to the drawings, FIG. 1 illustrates the system 10 of the invention employed in the context of an exemplary drying appliance, specifically a conventional clothes dryer 100 having a front loading door 110 providing access to a drum 120 for drying clothes or other textiles 1. Dryer 100 may further be provided with a lid or top surface 130 that may be pivotally secured to a dryer 100 top portion 140, for example through hinges 132 secured or disposed along a back edge of top portion 140 that permits top surface 130 to be pivoted upwardly into an open position or lowered into a closed position. In some aspects top surface 130 is capable of being opened to expose top portion 140 of dryer 100 or closed to provide a generally flat top surface 130 that securely covers top portion of dryer 100.

In various aspects and embodiments dryer 100 is provided with a basin or sink 160 disposed in top portion 140 above drum 120 that in various embodiments is capable of being exposed for use when top surface 130 is in its open position. In some embodiments basin 160 is equipped with a drain 162 positioned in a bottom portion 164 of basin 160. Drain 162 is in fluid communication with a drain line 170 for removing fluid from basin 160 and may further be equipped with a stopper 167 or shutoff valve 166 for closing drain 160 to prohibit water from flowing into drain line 170. Basin 160 may further include a supply water port or tap 180 that is in fluid communication with a water supply source 2 through a valve 190. Valve 190 may be in some embodiments a petcock or spigot while in some aspects valve 190 may be a solenoid actuated valve activated by a switch or user interface command, as will be discussed in further detail herein below.

Figure 2:
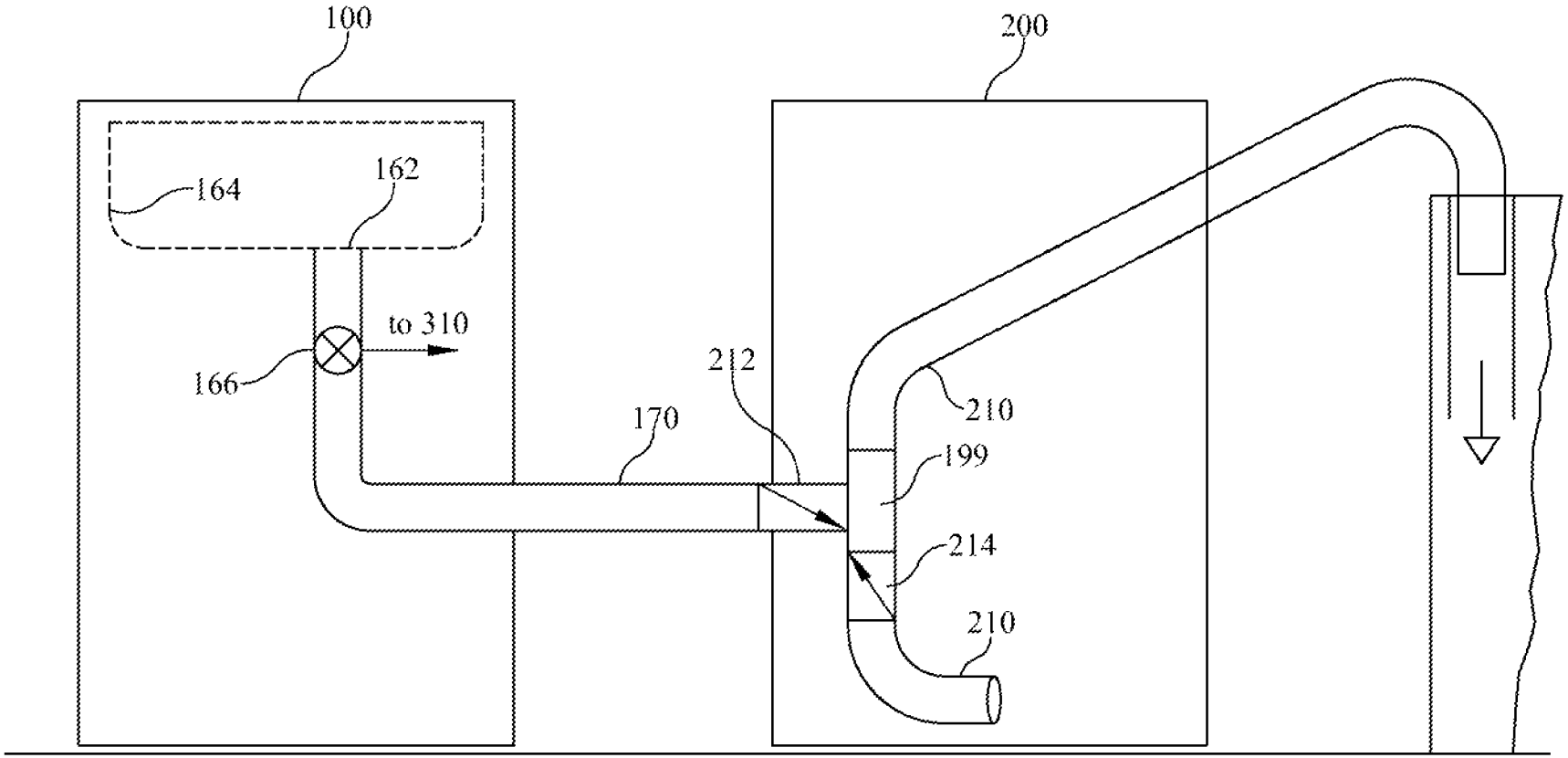
FIG. 2 is a perspective view of a washing and drying appliance and drain system in accordance with various embodiments of the invention.

Referring now to FIG. 2, and in accordance with some embodiments and exemplary aspects of the invention, dryer drain line 170 may be plumbed to be in fluid communication with an existing washer 200 drain line 210 via a tee 199 that is disposed in washer drain line 210. Tee 199 may include a first check valve 212 therein disposed proximate the point where the dryer drain line 170 enters tee 199 to prohibit waste water being removed from the washer 200 (and thus in washer drain line 210 from entering the dryer 100 drain line 170. Furthermore, tee 199 may additionally include a second check valve 214 disposed proximate the point where the washer drain line 210 enters tee 199 and below the point where dryer drain line 170 enters tee 199 to prohibit waste water flowing in dryer drain line 170 from entering washer 200 drain line 210. This arrangement of check valves 212, 214 and tee 199 provides a system that implements protection for both dryer 100 and washer 200 when the drain of the other appliance is being utilized.

Referring again to FIG. 1 and in accordance with some embodiments of the invention a controller 300 may be provided, having a processor 302 and concomitant data memory 304, capable of storing an instruction set for operation of processor 302. Processor 302 may also include a plurality of signal outputs 310 and signal inputs 320 that may be operatively connected to a plurality of system 10 components to monitor and direct system 10 operation. Furthermore, in some embodiments controller 300 may include a wireless or hard-wired communications interface 330 that enables controller 300 to communicate with external devices that may be integrated into system 10.

Additionally, controller 300 may be equipped with an operator interface 340 to provide audible or visual feedback to a user as well as provide a user the ability to provide instructions or commands to controller 300. Exemplary but non-limiting user interfaces that may be employed include a mouse, keypads, touch-screens, keyboards, switches and/or touch pads. Any user interface may be employed for use in the invention without departing from the scope thereof.

Figure 3:
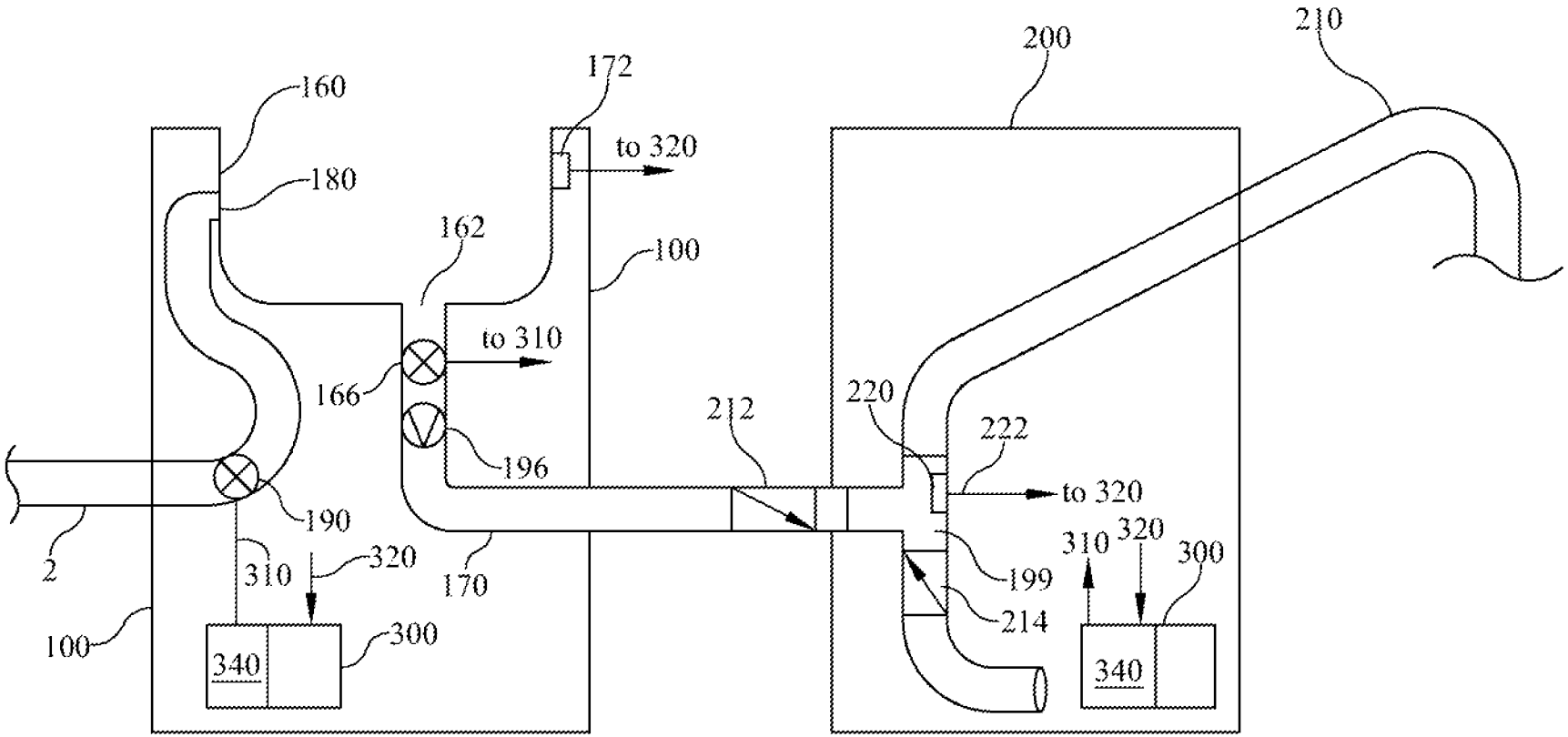
FIG. 3 is a perspective view of a washing and drying appliance and drain system in accordance with various embodiments of the invention.

In some aspects of the invention as depicted in FIG. 3, basin 160 may be equipped with a water level sensor 172 proximate the top edge of basin 160. Level sensor 172 may be operatively connected to an input 320 of controller 300 to provide an indication to controller of a high water level in basin 160. When basin level sensor 172 detects a high water level in basin 160 an input 320 is provided to controller 320 indicative of high basin water level. Basin water level sensor 172 may be one of many known fluid level sensors, such as a float switch or ultrasonic level detector without departing from the scope of the invention.

Additionally, in some embodiments water valve 190 may be operated by an output 310 of controller 300 such that a user may provide a command to turn water valve 190 on through user interface 340, or alternatively through operation of a switch that is operatively connected to an input 320 of controller 300. In an exemplary but non-limiting embodiment water valve 190 may be a solenoid operated valve.

In further embodiments controller 300 is provided with instructions that prohibit a user from operating water supply valve 190 When a high water level has been detected in basin 160 by water level sensor 172. This feature of the invention prevents basin 160 overflows when the drain 162 is closed or alternatively when the top of basin 160 is at an elevation below the highest elevation of the washer drain line 210. In other embodiments the washer basin 160 drain line 170 may be connected such that the highest elevation of the washer drain line 210 is below the elevation of the top of basin 160. In this aspect, the basin cannot overflow as long as the drain is not stoppered.

Referring again to FIG. 3 and in accordance with various embodiments a washer drain line 210 level sensor 220 is provided proximate tee 199 Level sensor 220 may be a conventional float switch and further may include an output 222 that is operatively connected to an input 320 of controller 300. Output 222 provides an indication to controller 300 that water is present in the washer 200 drain line 210. Furthermore, in some aspects and embodiments washer basin 160 drain 162 may be provided with a drain valve 166, for c ample a solenoid operated valve 166 that is actuated by an output 310 of controller 300 by use of a command provided through user interface 340. Alternatively, valve 166 may be a stop-cock or conventional drain open/close mechanism. In operation, where valve 192 is actuated by controller 300, instructions are provided to controller 300 to prohibit the operation of valve 166 when level sensor 220 output 222 indicates that water in present in the washer 200 drain line 210. In this embodiment, the user command supplied through user interface 340 to open drain valve 166 is ignored by controller 300 until level sensor 220 indicates no water in the washer drain line 210. Alternatively, where valve 166 is a manually operated valve, controller 300 may provide and audible and/or visual indication through user interface 340 that there is water present in the washer drain line 210, to alert a user not to open the basin drain valve 166.

In some aspects and embodiments of the invention dryer drain line 170 drains into tee 199 and thus washer drain line 210 by operation of gravity. In other aspects as depicted in FIG. 3 dryer 100 is provided with a pump 196 actuated by operation of an output 310 from controller 300. In these embodiments, controller 300 only allows operation of pump 196 when level sensor 220 indicates no water in the washer drain line 210.

In yet further embodiments both washer 200 and dryer 100 at each equipped with a controller 300 having a processor 302 and concomitant data memory 304, capable of storing an instruction set for operation of processor 302. Processor 302 may also include a plurality of signal outputs 310 and signal inputs 320 that may be operatively connected to a plurality of system 10 components to monitor and direct system 10 operation. As disclosed herein above, controllers 300 may include a wireless or hard-wired communications interface 330 that enables controller 300 to communicate with external devices that may be integrated into system 10. In one exemplary but non-limiting embodiment communications interlace 330 includes a wireless or hard-wired Internet connection thereby enabling washer 200 controller and dryer 100 controller to communicate. In other exemplary but non-limiting embodiments washer 200 controller 300 and dryer 100 controller 300 may have a Bluetooth, Zigbee or other equivalent wireless short-range communications interface 330 to permit washer 200 and dryer 100 to transmit data directly to and from each other without the necessity of Internet connectivity. A wide variety of communications interfaces may be employed to permit washer 200 and dryer 100 to communicate with each other without departing from the scope of the invention.

In additional aspects and embodiments dryer 100 controller 300 may transmit a signal to washer 200 controller 300 when a user provides a command to dryer operator interface 340 to actuate the basin 160 drain 162 and thus remove all the water from basin 160 In this embodiment washer 200 controller may operate the washer's integral drain pump to remove water from both dryer drain line 170 and washer drain line 210. These embodiments provide a system 10 that only utilizes the expense of a single pump that is already provided integral to washer 200 but does not require the dryer drain line 170 to be plumbed to drain by operation of gravity.

In other aspects and embodiments, washer 200 controller may monitor fluid level sensor 220 to operate washer 200 drain pump whenever water is sensed in the washer drain line and when the washer drain/spin cycle is ready to operate. In other words, the washer 200 would operate its drain pump as long as it wasn't in the middle of a wash cycle and the drain pump is capable of being operated without interrupting the washer's current cycle process.

While several embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the embodiments described herein. More generally, those skilled in the art will readily appreciate that all parameters, dimensions, materials, and configurations described herein are meant to be exemplary and that the actual parameters, dimensions, materials, and/or confipra-tions will depend upon the specific application or applications for which the teachings is/are used. Those skilled in the art. will recognize, or be able to ascertain using no more than routine experimentation, many equivalents to the specific embodiments described herein. It is, therefore, to be understood that the foregoing embodiments are presented by way of example only and that, within the scope of the appended claims and equivalents thereto, embodiments may be practiced otherwise than as specifically described and claimed. Embodiments of the present disclosure are directed to each individual feature, system, article, material, and/or method described herein. In addition, any combination of two or more such features, systems, articles, materials, and/or methods, if such features, systems, articles, materials, and/or methods are not mutually inconsistent, is included within the scope of the present disclosure.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in Conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of or" "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," referencein to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

It should also be understood that, unless clearly indicated to the contrary, in any methods claimed herein that include more than one step or act, the order of the steps or acts of the method is not necessarily limited to the order in which the steps or acts of the method are recited.

In the claims, as well as in the specification above, all transitional phrases such as "comprising," "including," "carrying," "having," "containing," "involving," "holding," "composed of", and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03.

It is to be understood that the embodiments are not limited in its application to the details of construction and the arrangement of components set forth in the description or illustrated in the drawings. The invention is capable of other embodiments and of being practiced or of being carried out in various ways. Unless limited otherwise, the terms "connected," "coupled," "in communication with," and "mounted," and variations thereof herein are used broadly and encompass direct and indirect connections, couplings, and mountings. In addition, the terms "connected" and "coupled" and variations thereof are not restricted to physical or mechanical connections or couplings.

The foregoing description of several embodiments of the invention has been presented for purposes of illustration. It is not intended to be exhaustive or to limit the invention to the precise steps and/or forms disclosed, and obviously many modifications and variations are possible in light of the above teaching.

The invention claimed is:

1. A system for treatment of an article, said system included in a drying appliance having a top surface comprising:

a basin disposed in the top surface of said drying appliance, said basin having a fluid drain therein connected to a basin drain line;

a water valve in fluid communication with a water source, said water valve having an outlet in fluid communication with said basin;

a controller having a processor for executing instructions, a concomitant data memory, a communications interface for sending and receiving data, and a plurality of inputs and outputs for receiving and providing electrical signals for said system;

an electrically actuated drain valve in said basin operatively coupled to an output of said controller for opening and closing said basin drain; and a tee connector configured to be coupled into a drain line of a washing appliance, said tee connector having an inlet in fluid communication with said basin drain line for removing water therefrom, and said tee connector including a fluid level sensor operatively coupled to said controller, whereby said controller prohibits actuation of said electrically actuated drain valve when said fluid level sensor indicates the presence of fluid in said tee connector.

2. The system as claimed in claim 1 comprising:

a first check valve disposed in said tee connector inlet and a second check valve disposed in said tee connector proximate said washing appliance drain line, thereby prohibiting fluid flow from said basin to said washing appliance.

3. The system as claimed in claim 1 wherein said water valve is an electrically actuated valve operatively coupled to an output of said controller.

4. The system as claimed in claim 3 comprising:

a second, high fluid level sensor disposed in said basin and having an output operatively connected to an input of said controller, wherein said controller prohibits actuation of said water valve when said second, high level fluid level sensor indicates a high water level in said basin.

5. The system as claimed in claim 1 wherein said communications interface is configured to transmit data representative of system operation to a remote user or processor.

6. The system as claimed in claim 5 wherein said controller is a first controller configured to communicate with a second controller of the washing appliance.

7. The system as claimed in claim 6 wherein said first controller is configured to receive from the second controller a permission to operate said electrically actuated drain valve and in response thereto activate said electrically actuated drain valve.

8. A system for treatment of an article, said system included in a drying appliance having a top surface and a washing appliance, each of said appliances having a processor for executing instructions, a concomitant data memory, a communications interface for sending and receiving data, and a plurality of inputs and outputs for receiving and providing electrical signals for said system, the system comprising:

a basin disposed in the top surface of said drying appliance, said basin having a fluid drain therein connected to a basin drain line;

a water valve in fluid communication with a water source, said water valve having an outlet in fluid communication with said basin; and a tee connector disposed in a drain line of a washing appliance, said tee connector having an inlet in fluid communication with said basin drain line for removing water therefrom, said tee connector including a fluid level sensor configured to sense a presence of fluid in said tee connector to control draining of fluid from said basin.

9. The system as claimed in claim 8 comprising:

a first check valve disposed in said tee connector inlet and a second check valve disposed in said tee connector proximate said washing appliance drain line, thereby prohibiting fluid flow from said basin to said washing appliance.

10. The system as claimed in claim 8 wherein said water valve is an electrically actuated valve operatively coupled to an output of said processor of said drying appliance.

11. The system as claimed in claim 10 comprising:

a second, high fluid level sensor disposed in said basin having an output operatively connected to an input of said processor of said drying appliance, wherein said processor of said drying appliance prohibits actuation of said water valve when said second, high level fluid level sensor indicates a high water level in said basin.

12. The system as claimed in claim 8 comprising:

an electrically actuated drain valve in said basin operatively coupled to an output of said processor of said drying appliance for opening and closing said basin drain.

13. The system as claimed in claim 12 wherein said fluid level sensor is operatively coupled to an input of said processor of said washing appliance, whereby said processor of said washing appliance prohibits actuation of said electrically actuated drain valve when said fluid level sensor indicates the presence of fluid in said tee connector.

14. The system as claimed in claim 13 comprising:

a plurality of user interface controls for actuating said water valve and said electrically actuated drain valve.

15. The system as claimed in claim 8, wherein said processor of said washing appliance is configured to actuate a drain pump of said washing appliance to remove water from said basin drain line in response to said fluid level sensor sensing a presence of fluid in said tee connector.

16. The system as claimed in claim 8, wherein said processor of said washing appliance is configured to communicate a signal to said processor of said drying appliance to inhibit draining of fluid from said basin drain line when said fluid level sensor indicates the presence of fluid in said tee connector.

17. The system as claimed in claim 8, wherein said processor of said drying appliance is configured to communicate a signal to said processor of said washing appliance to cause said processor of said washing appliance to actuate a drain pump of said washing appliance to remove water from said basin drain line.

18. A system for treatment of an article, said system included in a drying appliance having a top surface comprising:

a basin disposed in the top surface of said drying appliance, said basin having a fluid drain therein connected to a basin drain line;

a water valve in fluid communication with a water source, said water valve having an outlet in fluid communication with said basin;

a first controller having a processor for executing instructions, a concomitant data memory, a communications interface for sending and receiving data, and a plurality of inputs and outputs for receiving and providing electrical signals for said system; and a tee connector configured to be coupled into a drain line of a washing appliance, said tee connector having an inlet in fluid communication with said basin drain line for removing water therefrom;

wherein said first controller is configured to communicate a command signal to a second controller of the washing appliance to cause the second controller of the washing appliance to actuate a drain pump of the washing appliance to remove water from said basin drain line.

19. The system of claim 18, wherein said first controller is configured to communicate the command signal to the second controller of the washing appliance to cause the second controller of the washing appliance to actuate the drain pump of the washing appliance to remove water from said basin drain line in response to a user command directed to the drying appliance.

* * * * *